US011607781B2

(12) United States Patent
Usui

(10) Patent No.: US 11,607,781 B2
(45) Date of Patent: Mar. 21, 2023

(54) TOOL FOR ATTACHING AND DETACHING ROTARY BODY AND METHOD FOR ATTACHING AND DETACHING ROTARY BODY

(71) Applicant: Honda Motor Co., Ltd., Tokyo (JP)

(72) Inventor: Akihiro Usui, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 690 days.

(21) Appl. No.: 16/358,712

(22) Filed: Mar. 20, 2019

(65) Prior Publication Data

US 2019/0299373 A1 Oct. 3, 2019

(30) Foreign Application Priority Data

Mar. 30, 2018 (JP) ..... JP2018-068475

(51) Int. Cl.

| | |
|---|---|
| ***B25B 23/00*** | (2006.01) |
| ***B25B 17/02*** | (2006.01) |
| ***B25B 27/14*** | (2006.01) |
| ***B25B 13/06*** | (2006.01) |
| *B25B 33/00* | (2006.01) |

(52) U.S. Cl.

CPC ..... *B25B 23/0035* (2013.01); *B25B 13/06* (2013.01); *B25B 17/02* (2013.01); *B25B 27/14* (2013.01); *B25B 33/00* (2013.01)

(58) Field of Classification Search

CPC ..... B25B 23/0035; B25B 13/06; B25B 17/02; B25B 27/14; B25B 27/0035; B25B 33/00; Y10T 29/53796; Y10T 29/538; Y10T 29/53909; Y10T 29/53687

See application file for complete search history.

(56) References Cited

U.S. PATENT DOCUMENTS 2,485,169 A * 10/1949 Roeschke ..... B25B 13/102 81/185
4,922,749 A * 5/1990 Steffes ..... G01M 15/06 73/114.26

(Continued)

FOREIGN PATENT DOCUMENTS

CN 202318172 7/2012
CN 202943593 5/2013

(Continued)

OTHER PUBLICATIONS

Office Action of China Counterpart Application, with English translation thereof, dated Mar. 11, 2021, pp. 1-14.

(Continued)

*Primary Examiner* — Lee D Wilson
(74) *Attorney, Agent, or Firm* — JCIPRNET

(57) ABSTRACT

An attaching and detaching tool for removing a flywheel connected to a crankshaft of an internal combustion engine using a nut, in which the flywheel is removed by pulling the flywheel with an axial force generated in the nut when the nut is loosened, is provided. A socket wrench is coupled to a nut connected to a crankshaft and a flywheel is coupled to a puller assembled to the socket wrench via a bolt, and then the socket wrench is rotated while the rotation of the puller is stopped by a spinner handle, whereby the nut is loosened and the flywheel is removed.

6 Claims, 6 Drawing Sheets

(56) References Cited

U.S. PATENT DOCUMENTS

| | | | | | |
|---|---|---|---|---|---|
| 4,979,409 | A * | 12/1990 | Garrett | B25B 27/0035 | 81/484 |
| 5,320,005 | A * | 6/1994 | Hsiao | B25B 27/023 | 81/437 |
| 5,607,247 | A * | 3/1997 | Lauritano | B25B 27/0035 | 474/166 |
| 6,640,670 | B2 * | 11/2003 | Belcher | B25B 27/0035 | 81/176.1 |
| 2003/0029284 | A1 * | 2/2003 | Malchus | B25G 1/085 | 81/490 |
| 2005/0086785 | A1 * | 4/2005 | Young | B25B 11/02 | 29/239 |
| 2006/0117916 | A1 * | 6/2006 | Hsieh | B25B 13/06 | 81/124.4 |

FOREIGN PATENT DOCUMENTS

| | | |
|---|---|---|
| CN | 204621963 | 9/2015 |
| CN | 206653321 | 11/2017 |
| DE | 202010002926 | 7/2010 |
| JP | S5039919 | 11/1975 |
| JP | S5228300 | 2/1977 |
| JP | S615577 | 1/1986 |
| JP | 2010249265 | 11/2010 |
| KR | 100913238 | 8/2009 |
| WO | 2004039535 | 5/2004 |

OTHER PUBLICATIONS

"Office Action of China Counterpart Application", dated Jun. 24, 2020, with English translation thereof, pp. 1-15.

Office Action of China Counterpart Application, with English translation thereof, dated Jan. 25, 2022, pp. 1-8.

"Office Action of China Counterpart Application" with English translation thereof, dated Aug. 30, 2021, p. 1-p. 17.

"Office Action of Japan Counterpart Application" with English translation thereof, dated Sep. 1, 2021, p. 1-p. 4.

* cited by examiner

TOOL FOR ATTACHING AND DETACHING ROTARY BODY AND METHOD FOR ATTACHING AND DETACHING ROTARY BODY

CROSS-REFERENCE TO RELATED APPLICATION

This application claims the priority benefit of Japan Application No. 2018-068475, filed on Mar. 30, 2018. The entirety of the above-mentioned patent application is hereby incorporated by reference herein and made a part of this specification.

BACKGROUND

Technical Field

In a mechanical device with a prime mover such as an internal combustion engine, a rotary body (a flywheel) is fastened to an end portion of a rotary shaft (a crankshaft) connected to a driving source using a nut.

On the other hand, in order to maintain the mechanical device or to replace components thereof, it is necessary to remove the rotary body from the rotary shaft. However, in such a mechanical device, the rotary shaft and the rotary body are tapered and fitted to each other to be securely fixed with a large tightening torque in many cases. Accordingly, in conventional tools, since a tool for loosening the nut and a tool for removing the rotary body are separately required and a number of steps using these tools for attachment and detachment are required, there is a problem that workability is poor and the rotary body cannot be removed in some cases.

Therefore, it is an object of the present invention to provide a novel tool for attaching and detaching a rotary body and a method for attaching and detaching the same in which the operation of loosening a nut from a rotary shaft and the operation of removing a rotary body can be continuously performed in one operation, so that the number of attaching and detaching steps can be reduced and the workability can be improved.

Description of Related Art

A mechanical device is already known from the following Patent Document 1 in which, in the case of removing a rotary body fastened by a bolt from a rotary shaft, an axial force transmission portion for transmitting an axial force in a pullout direction of the bolt to the rotary body when loosening the bolt from the state where the rotary body has been fastened to the rotary shaft is provided.

In the mechanical device disclosed in Patent Document 1, a C-shape stopper 10 is prepared in order to transmit the axial force in the pullout direction of a set bolt 210 to a pulley (the rotary body) 1, and it is further required to specially provide a groove 32 for engaging the C-shape stopper 10 on the set bolt. Thus, there is a problem that, in order to generate the axial force, it is necessary to modify the structure of the bolt 210 and further prepare the C-shape stopper 10 separately.

Patent Documents

[Patent Document 1] Japanese Laid-open No. 2010-249265

SUMMARY

In order to achieve the above object, the invention according to claim 1 is a tool for attaching and detaching a rotary body fastened by a nut to an end portion of a rotary shaft, including:

a socket wrench which is connected to the nut to operate the nut to rotate; a puller which is detachably connected to the socket wrench to operate the socket wrench to rotate; a bolt which passes through the puller in a freely retractable manner and is connected to the rotary body; and a rotation prevention tool for the puller, which is characterized in that, in a rotation prevention state of the puller, the rotary body is detached from the rotary shaft by a loosening operation of the nut resulting from a rotating operation of the socket wrench.

In order to achieve the above object, the invention according to claim 2 is a tool for attaching and detaching a rotary body fastened by a nut to an end portion of a rotary shaft, including:

a socket wrench which is connected to the nut to operate the nut to rotate; a puller which is detachably connected to the socket wrench to operate the socket wrench to rotate; a bolt which passes through the puller in a freely retractable manner and is connected to the rotary body; and a rotation prevention tool for the puller, which is characterized in that, in a rotation prevention state of the puller, the rotary body is fastened to the rotary shaft by a fastening operation of the nut resulting from a rotating operation of the socket wrench.

Also, in order to achieve the above object, the invention according to claim 3 is a method of attaching and detaching the rotary body to and from the rotary shaft by using the tool for attaching and detaching the rotary body according to claim 1 or 2, which is characterized in that the socket wrench is coupled to the nut fastened to the rotary shaft, and the rotary body is coupled to the puller assembled to the socket wrench via the bolt to rotate the socket wrench forward and backward while preventing the rotation of the puller, whereby the nut is loosened or fastened to detach or attach the rotary body from or to the rotary shaft.

BRIEF DESCRIPTION OF THE DRAWINGS

FIG. 2(A) is a cross-sectional view taken along the line A-A in FIG. 2(B), and FIG. 2(B) is a side view seen from along the line B-B in FIG. 2(A).

FIG. 3(A) is a cross-sectional view taken along the line A-A in FIG. 3(B), and FIG. 3(B) is a side view seen from along the line B-B in FIG. 3(A).

FIG. 4(A) is a cross-sectional view taken along the line A-A in FIG. 4(B), and FIG. 4(B) is a side view seen from along the line B-B in FIG. 4(A).

DESCRIPTION OF THE EMBODIMENTS

Figure 1:
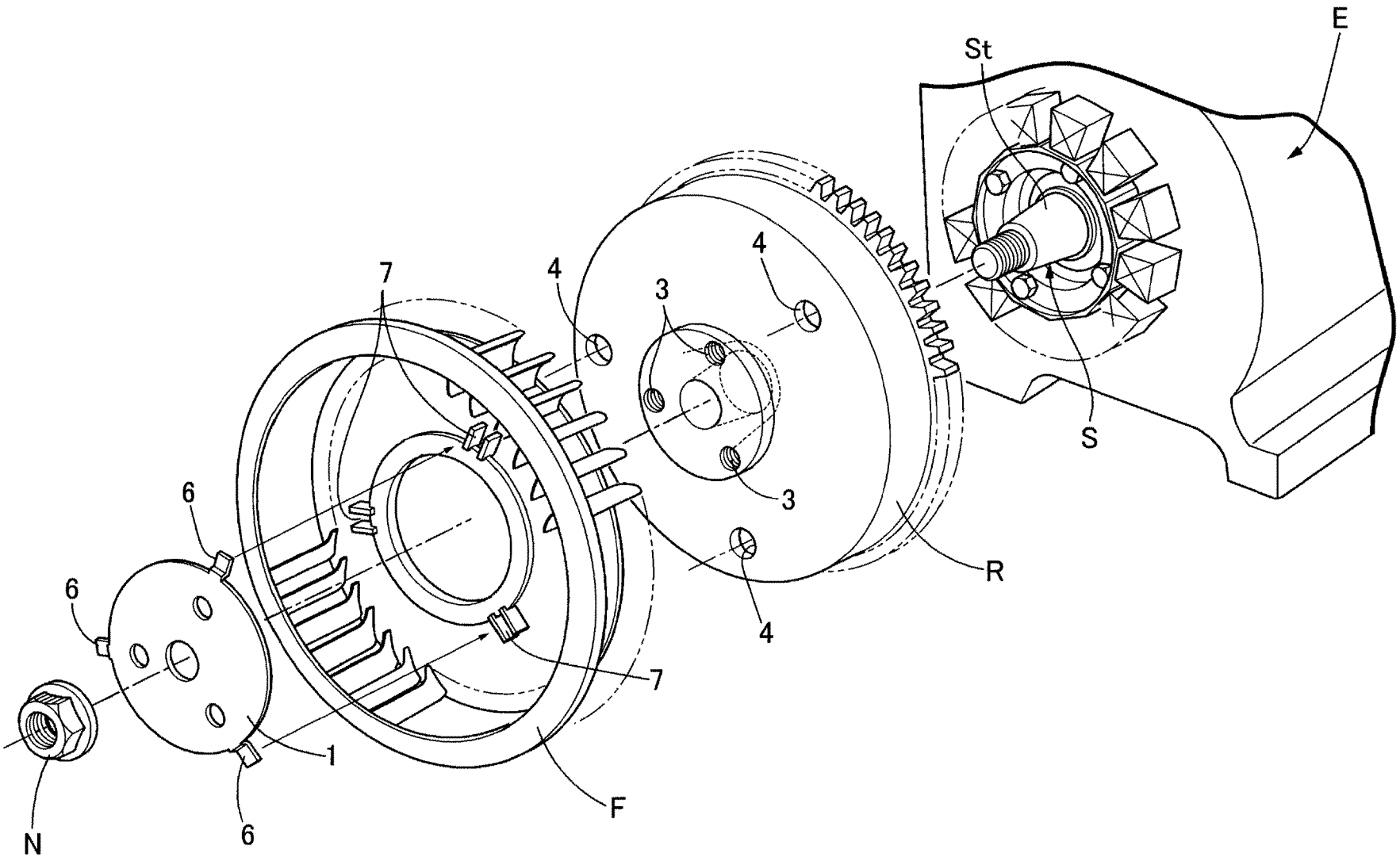
FIG. 1 is an exploded perspective view of an internal combustion engine, a flywheel and a cooling fan connected to a crankshaft.

It is an object of the present invention to provide a novel attaching and detaching tool and an attaching and detaching method thereof in which an axial force can be generated in a nut that connects a rotary shaft and a rotary body to easily perform attaching and detaching (removing or fastening) between the rotary shaft and the rotary body, without modifying the structure of a connection portion between a rotary shaft and a rotary body and without requiring a separate member.

In order to achieve the above object, the invention according to claim 1 is a tool for attaching and detaching a rotary body fastened by a nut to an end portion of a rotary shaft, including:

a socket wrench which is connected to the nut to operate the nut to rotate; a puller which is detachably connected to the socket wrench to operate the socket wrench to rotate; a bolt which passes through the puller in a freely retractable manner and is connected to the rotary body; and a rotation prevention tool for the puller, which is characterized in that, in a rotation prevention state of the puller, the rotary body is detached from the rotary shaft by a loosening operation of the nut resulting from a rotating operation of the socket wrench.

In order to achieve the above object, the invention according to claim 2 is a tool for attaching and detaching a rotary body fastened by a nut to an end portion of a rotary shaft, including:

a socket wrench which is connected to the nut to operate the nut to rotate; a puller which is detachably connected to the socket wrench to operate the socket wrench to rotate; a bolt which passes through the puller in a freely retractable manner and is connected to the rotary body; and a rotation prevention tool for the puller, which is characterized in that, in a rotation prevention state of the puller, the rotary body is fastened to the rotary shaft by a fastening operation of the nut resulting from a rotating operation of the socket wrench.

Also, in order to achieve the above object, the invention according to claim 3 is a method of attaching and detaching the rotary body to and from the rotary shaft by using the tool for attaching and detaching the rotary body according to claim 1 or 2, which is characterized in that the socket wrench is coupled to the nut fastened to the rotary shaft, and the rotary body is coupled to the puller assembled to the socket wrench via the bolt to rotate the socket wrench forward and backward while preventing the rotation of the puller, whereby the nut is loosened or fastened to detach or attach the rotary body from or to the rotary shaft.

Further, in order to achieve the above object, the invention according to claim 4 is the invention according to claim 1, 2 or 3, which is characterized in that the rotary shaft is a crankshaft of an internal combustion engine, and the rotary body is a flywheel press-fitted to an end portion of the crankshaft.

According to the invention according to claim 1, without any structural changes to the rotary shaft, the rotary body and the nut, and without separately preparing a detachable member, the axial force can be generated in the nut by rotating the socket wrench connected to the nut, and the rotary body can be detached from the rotary shaft.

According to the invention according to claim 2, without any structural changes to the rotary shaft, the rotary body and the nut, and without separately preparing a detachable member, the axial force can be generated in the nut by rotating the socket wrench connected to the nut, and the rotary body can be fastened to the rotary shaft.

According to the invention according to claim 3, since the axial force can be generated in the nut by rotating the nut connecting the rotary body to the rotary shaft and the rotary body to move the rotary body in the axial direction, it is possible to loosen the nut and detach the rotary body, or to assemble the rotary body and fasten the nut by a single operation of the detaching tool, whereby the man-hours for detachment can be reduced and the workability can be improved.

According to the invention according to claim 4, the rotary shaft can be a crankshaft of the internal combustion engine and the rotary body can be a flywheel press-fitted to the end portion of the crankshaft.

Embodiments of the present invention will be described with reference to the accompanying drawings.

Hereinafter, embodiments in which a rotary shaft is a crankshaft S of an internal combustion engine and a rotary body is a flywheel R will be described.

Figure 2A:
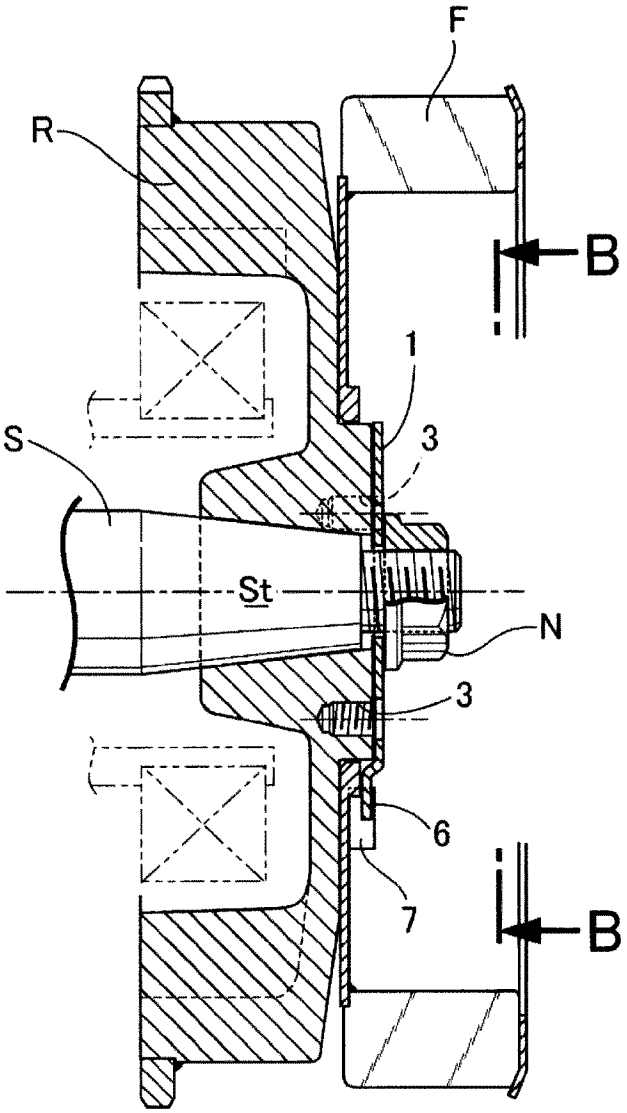
FIG. 2(A) and FIG. 2(B) are diagrams for assembling the crankshaft, the flywheel and the cooling fan.
Figure 2B:
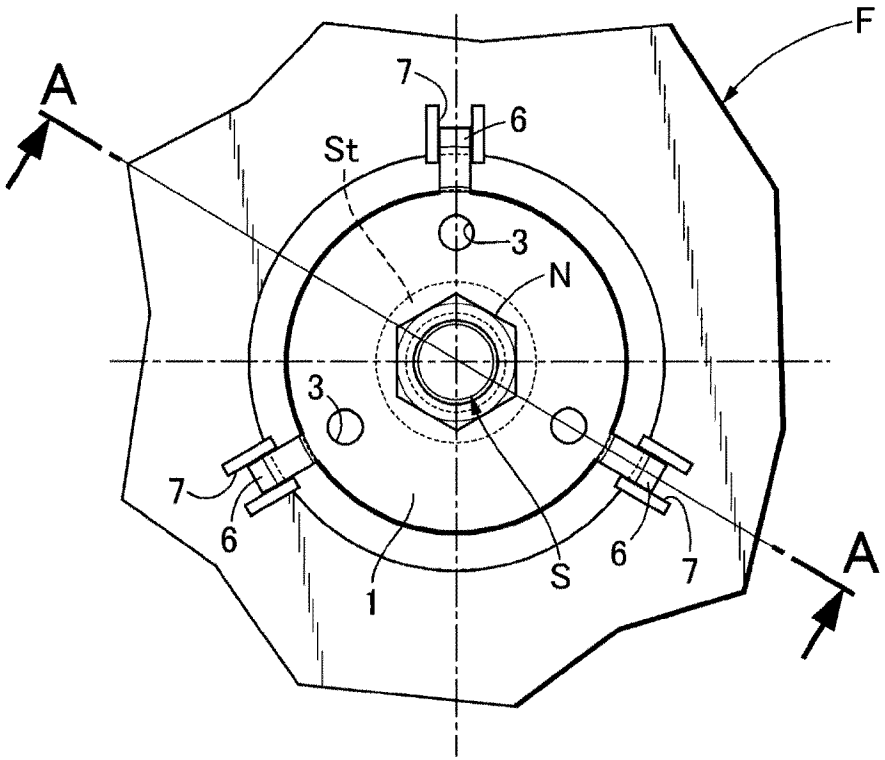

In FIGS. 1, 2(A) and 2(B), a flywheel (a rotary body) R is press-fitted to a tapered shaft St of an end portion of a crankshaft (a rotary shaft) S which is rotatably supported by an internal combustion engine E, a cooling fan F is juxtaposed on an outer surface of the flywheel R via a setting plate 1, and the cooling fan F is fixed to the end portion of the crankshaft S by a nut N screwed to the end portion of the crankshaft S. Protruding portions 6 protruding from an outer periphery of the setting plate 1 are engaged with recessed portions 7 provided in the cooling fan F.

The flywheel R press-fitted to the tapered shaft St of the crankshaft S is fixed to the tapered shaft St of the crankshaft S by the nut N screwed to an outer end of the tapered shaft St.

A plurality of screw holes 3 are formed on the outer surface of the flywheel R at intervals in the circumferential direction in advance, and these screw holes 3 are used as tool attachment holes for mounting general-purpose products (not shown) and are used as attachment holes for an attaching and detaching tool T according to the present invention, which will be described later.

Also, as shown in FIG. 1, a plurality of holes 4 for positioning the cooling fan F and stopping rotation of the cooling fan F are preliminarily formed on the outer surface of the flywheel R. These holes 4 may be used as attachment holes of the attaching and detaching tool T according to the present invention instead of the screw holes 3.

In the case of removing the flywheel R from the crankshaft S, the flywheel R is removed through the procedure in which, when the nut N fastening the flywheel R to the crankshaft S is loosened, the flywheel R is pulled out from the crankshaft S by an axial force generated on the nut N.

Also, in the case of fastening the flywheel R to the crankshaft S, the flywheel R is fastened to the crankshaft S through the procedure in which, when the flywheel R is fastened to the crankshaft S with the nut N, the flywheel R is screwed onto the crankshaft S by an axial force generated on the nut N.

Next, with reference to FIGS. 3(A) to 6, the attaching and detaching tool T according to the present invention which removes the flywheel (the rotary body) R from the crankshaft (the rotary shaft) S or fastens the flywheel R to the crankshaft S will be described.

The attaching and detaching tool T includes a socket wrench 10, a puller 20 and bolts 30, and utilizes the axial force when the nut N fastening the flywheel R to the crankshaft S is loosened, so that a pulling force can be applied to the flywheel R to remove the flywheel R from the crankshaft S.

The socket wrench 10 includes a socket portion 11 and a wrench portion 12. A fitting recess 15 is formed in the socket portion 11 to be engaged with the nut N connecting the flywheel R to the crankshaft S. A puller 20 is slidably fitted in the axial direction to an outer peripheral surface of the wrench portion 12. A stepped portion 13 that can be engaged with the puller 20 via a washer 40 is formed on a back surface of the socket portion 11. Also, a coupling engagement recess 14 of a ratchet handle Hr, which will be described later, is formed at an outer end of the wrench portion 12. In addition, as will be described later, the nut N can be loosened by the rotation in the loosening direction (the left direction) of the ratchet handle Hr. Further, a disc-shaped puller 20 is slidably inserted into the outer peripheral surface of the wrench portion 12 of the socket wrench 10. In the puller 20, a plurality of (three) bolt insertion holes 21 having elliptical shapes extending in the radial direction are opened at intervals in the circumferential direction. The bolts 30 are inserted into the bolt insertion holes 21 from the outside of the puller 20, and these bolts 30 are screwed into the aforementioned screw holes 3 provided in a boss portion of the flywheel R via a collar 41. Thus, the puller 20 is integrally connected to the flywheel R via a plurality of detachable bolts 30, and the axial force of the nut N generated when the nut N is loosened by the socket wrench 10 can be transmitted to the flywheel R via the puller 20, whereby the flywheel R can be pulled out.

Figure 4A:
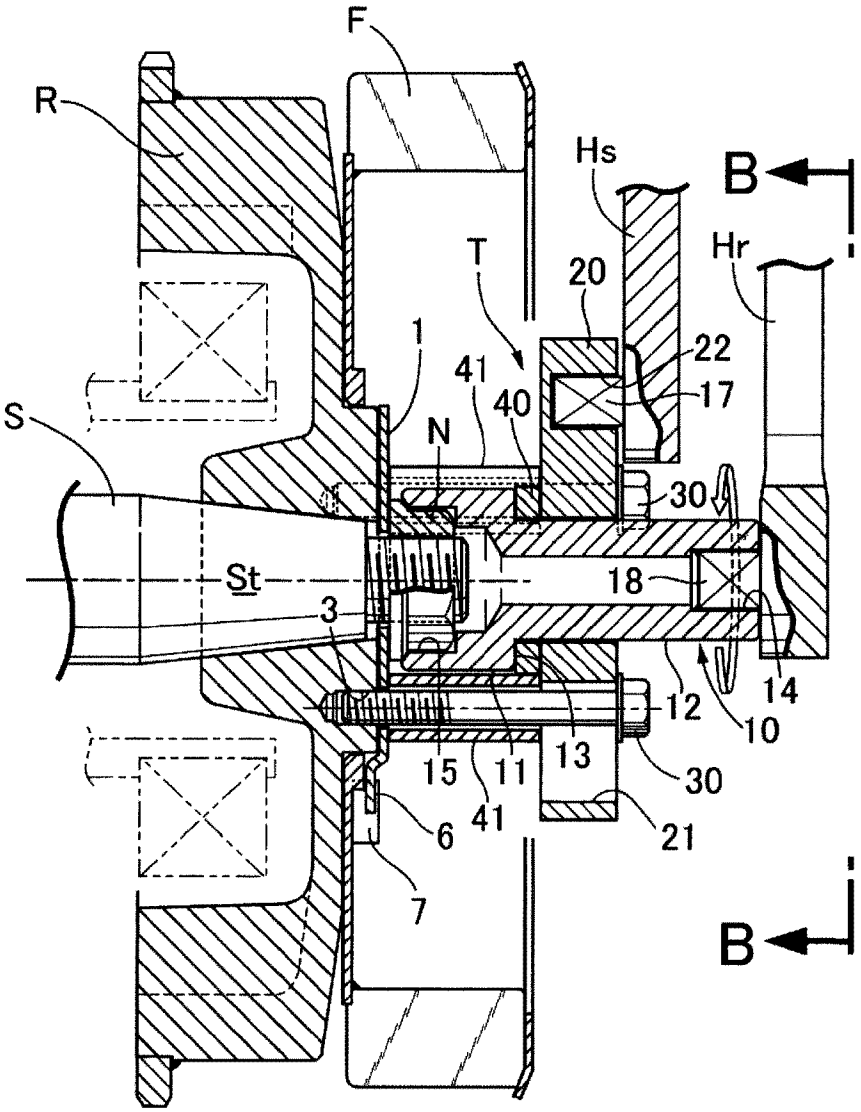
FIG. 4(A) and FIG. 4(B) are diagrams showing a state in which the attaching and detaching tool is set on the crankshaft and the flywheel.
Figure 4B:
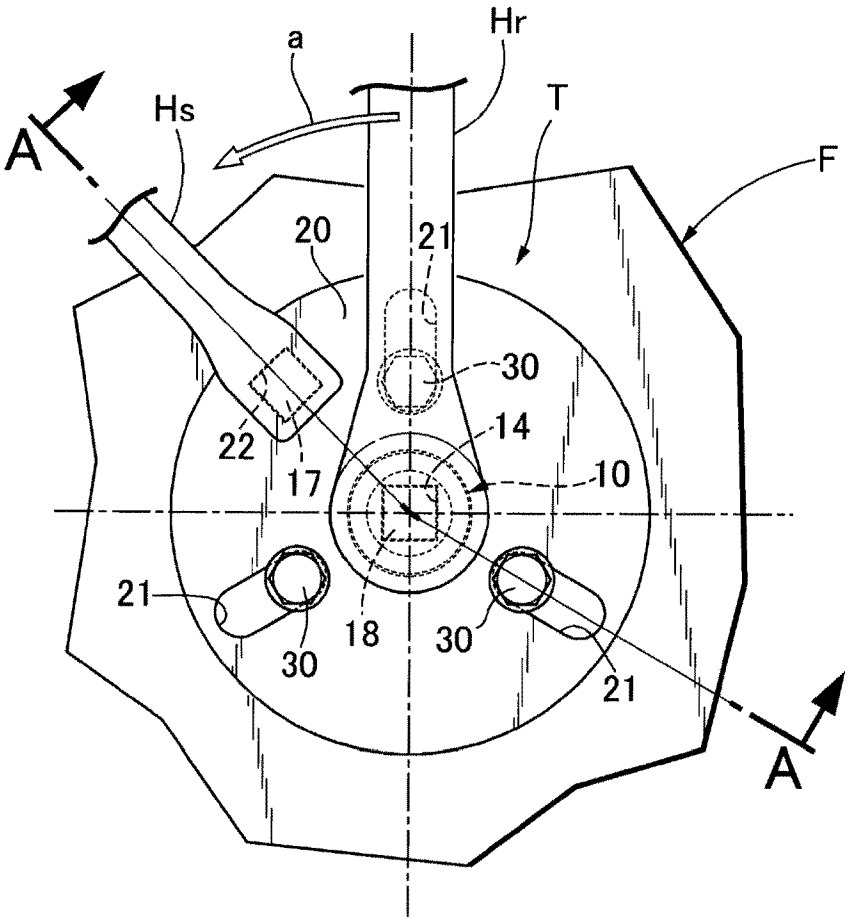
Figure 5:
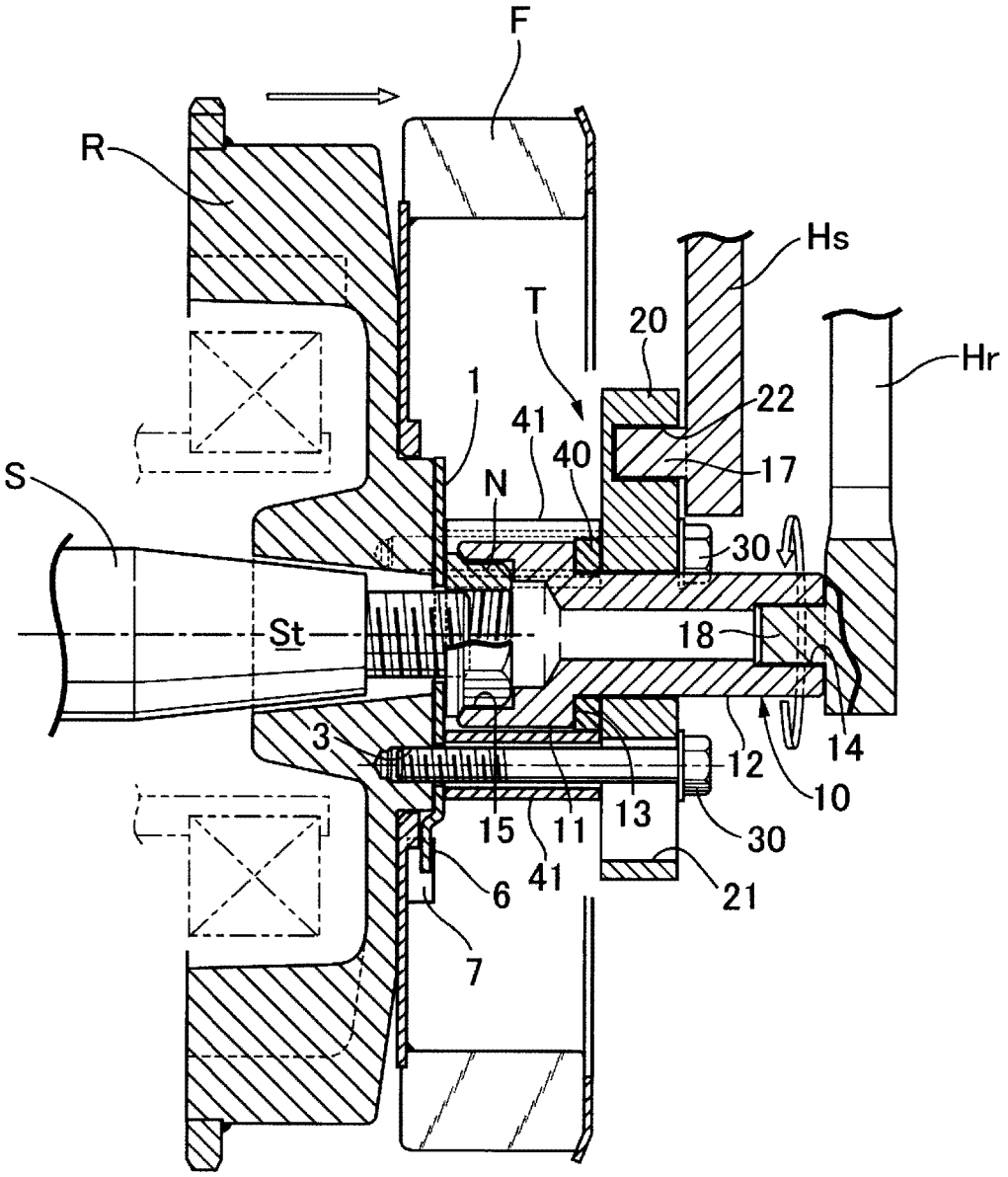
FIG. 5 is a cross-sectional view showing a state in which the flywheel has moved from the crankshaft in a detaching direction.
Figure 6:
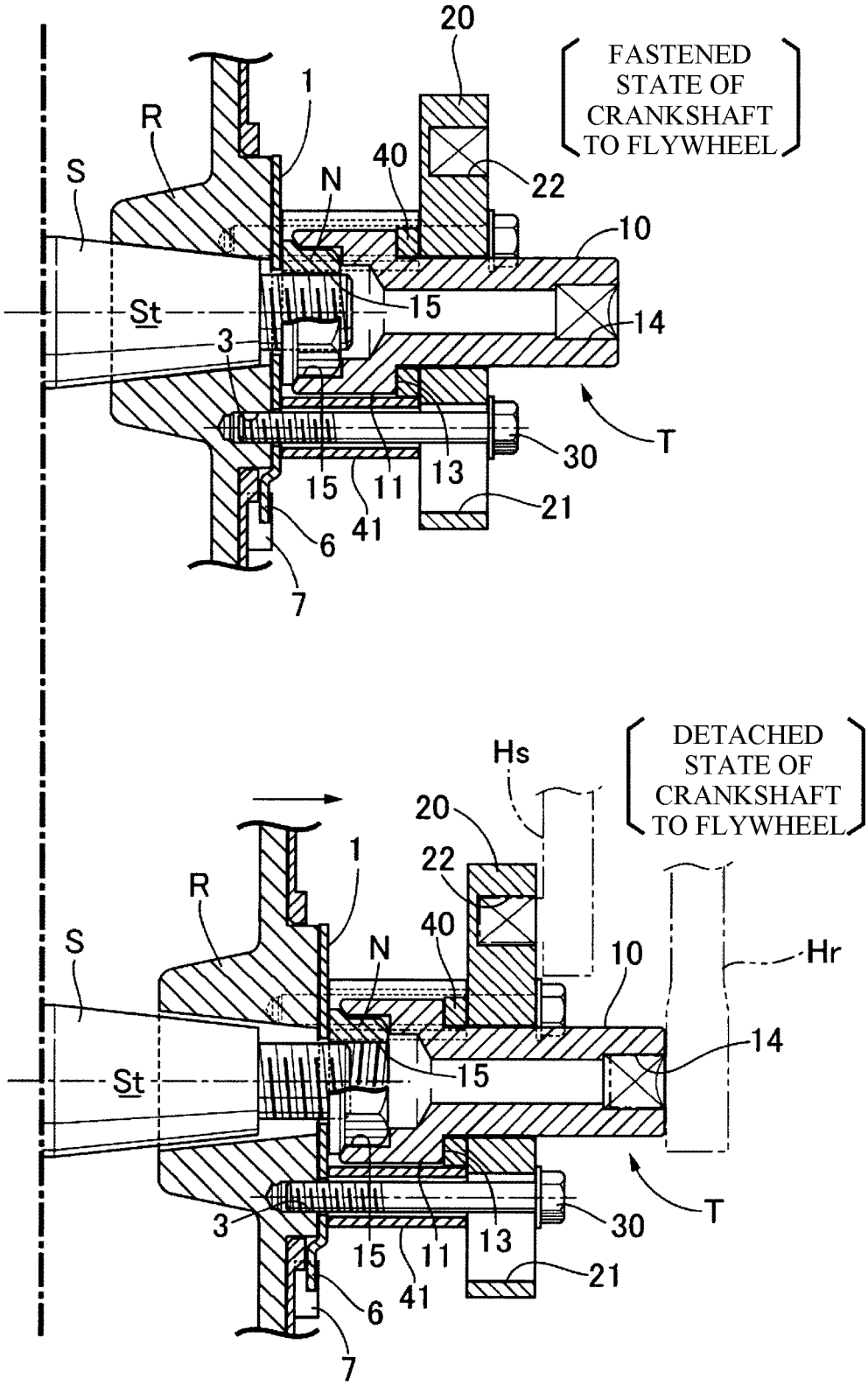
FIG. 6 is a cross-sectional view showing a process in which the flywheel is detached from the crankshaft.

A rectangular tool insertion hole 22 is cut in an outer surface of the puller 20, and as shown in FIG. 4(A) and FIG. 4(B), a rotation prevention spinner handle Hs is detachably inserted into the tool insertion hole 22, so that the rotation of the puller 20 can be suppressed.

Next, with reference to FIGS. 4(A) to 6, a process of removing the flywheel (the rotary body) R fixed by the nut N to the crankshaft (the rotary shaft) S using the attaching and detaching tool T will be described.

The flywheel R is removed from the crankshaft S through the following processes using a plurality of empty screw holes 3 (tool attachment holes for mounting general purpose articles) opened in the flywheel R.

Figure 3A:
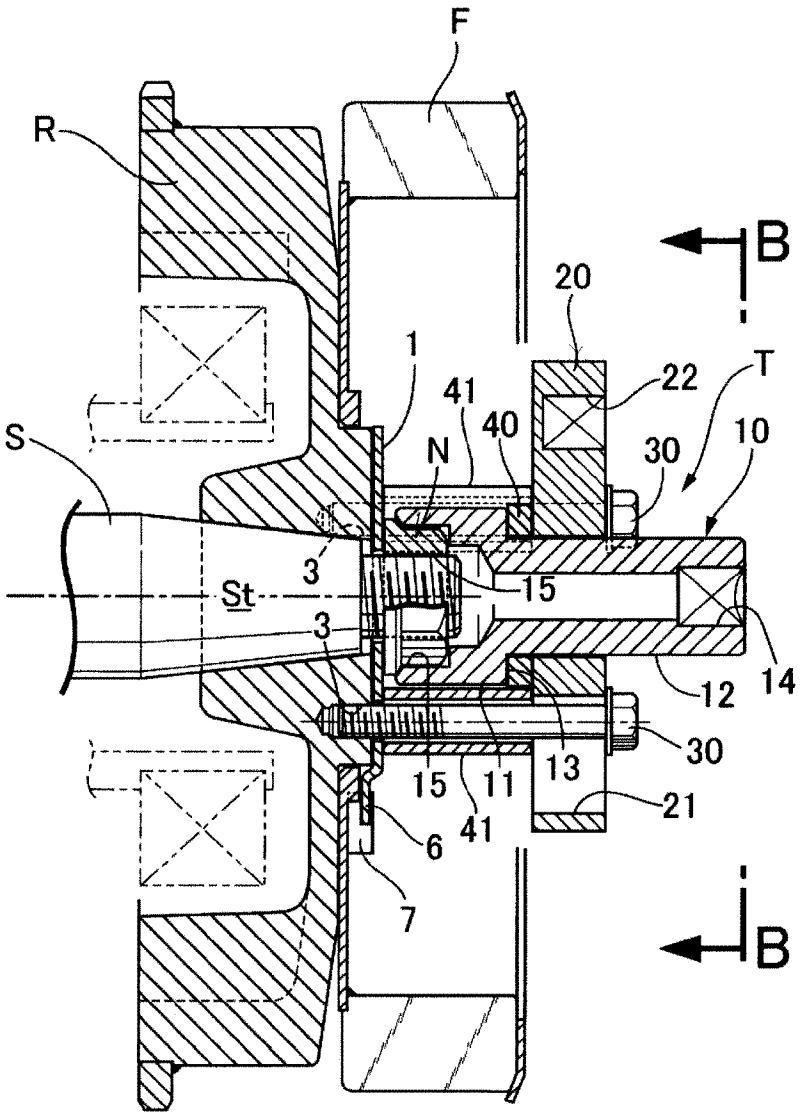
FIG. 3(A) and FIG. 3(B) are diagrams for assembling the crankshaft, the flywheel, the cooling fan, and an attaching and detaching tool.
Figure 3B:
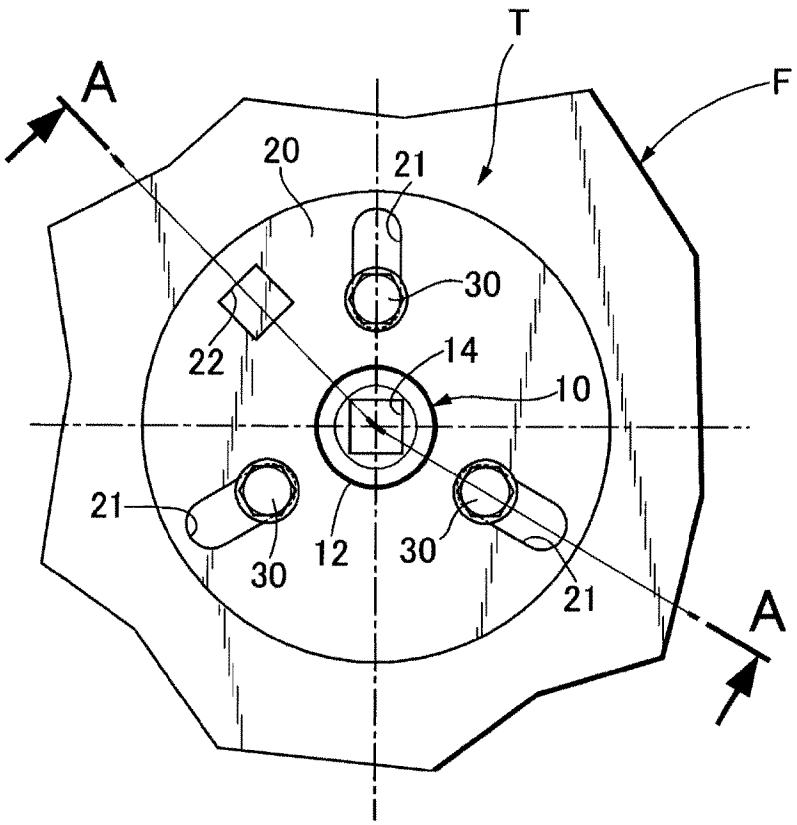

(1) As shown in FIG. 3(A) and FIG. 3(B), the puller 20 is fitted to the outer periphery of the wrench portion 12 of the socket wrench 10 with the fitting recess 15 of the socket portion 11 of the socket wrench 10 fitted to the nut N, and a plurality of (three) bolts 30 inserted into the puller 20 are tightened in a secure manner to the plurality of empty screw holes 3 through the collar 41. Thus, the puller 20 is fixed to the flywheel R.

(2) Next, as shown in FIG. 4(A) and FIG. 4(B), a protrusion 17 at the tip of the spinner handle Hs is inserted into the tool insertion hole 22 of the puller to prevent the rotation of the puller 20.

(3) While the rotation of the puller 20 by the spinner handle Hs is stopped, an engagement protruding portion 18 of the ratchet handle Hr is engaged with the engagement recess 14 of the outer end of the socket wrench 10, and the ratchet handle Hr is rotated in the loosening direction (the direction of arrow a in FIG. 4(B)), so that the nut N is rotated in the loosening direction via the socket wrench 10.

(4) By continuously rotating the nut N in the loosening direction, the puller 20 is pushed outward through the socket wrench 10. Since the puller 20 and the flywheel R are integrally connected, the axial force of the nut N is transmitted to the flywheel R via the puller 20, and the flywheel R can be pulled out from the crankshaft S.

In addition, in order to fasten the flywheel R to the crankshaft S using the attaching and detaching tool T, the operations (1) to (4) described above may be performed in reverse.

Although the crankshaft is used as the rotation axis S and the flywheel is used as the rotation body R in the above embodiment, the present invention is applicable to general rotary shafts and rotary bodies.

It will be apparent to those skilled in the art that various modifications and variations can be made to the disclosed embodiments without departing from the scope or spirit of the disclosure. In view of the foregoing, the disclosure is intended to cover modifications and variations provided that they fall within the scope of the following claims and their equivalents.

What is claimed is:

1. A tool for attaching and detaching a rotary body fastened by a nut to an end portion of a rotary shaft, comprising:

a socket wrench which is connected to the nut to operate the nut to rotate;

a puller which is detachably connected to the socket wrench to operate the socket wrench to rotate;

a bolt which passes through the puller in a freely retractable manner and is directly connected to the rotary body; and a rotation prevention tool for the puller, wherein, in a rotation prevention state of the puller, the rotary body is detached from the rotary shaft by a loosening operation of the nut resulting from a rotating operation of the socket wrench, wherein the socket wrench includes a stepped portion which is engaged with the puller.

2. A tool for attaching and detaching a rotary body fastened by a nut to an end portion of a rotary shaft, comprising:

a socket wrench which is connected to the nut to operate the nut to rotate;

a puller which is detachably connected to the socket wrench to operate the socket wrench to rotate;

a bolt which passes through the puller in a freely retractable manner and is directly connected to the rotary body; and a rotation prevention tool for the puller, wherein, in a rotation prevention state of the puller, the rotary body is fastened to the rotary shaft by a fastening operation of the nut resulting from a rotating operation of the socket wrench, wherein the socket wrench includes a stepped portion which is engaged with the puller.

3. A method of attaching and detaching the rotary body to and from the rotary shaft by using the tool for attaching and detaching the rotary body according to claim 1, wherein the socket wrench is coupled to the nut fastened to the rotary shaft, and the rotary body is coupled to the puller assembled to the socket wrench via the bolt to rotate the socket wrench forward and backward while preventing the rotation of the puller, whereby the nut is loosened or fastened to detach or attach the rotary body from or to the rotary shaft.

4. A method of attaching and detaching the rotary body to and from the rotary shaft by using the tool for attaching and detaching the rotary body according to claim 2, wherein the socket wrench is coupled to the nut fastened to the rotary shaft, and the rotary body is coupled to the puller assembled to the socket wrench via the bolt to rotate the socket wrench forward and backward while preventing the rotation of the puller, whereby the nut is loosened or fastened to detach or attach the rotary body from or to the rotary shaft.

5. The method of attaching and detaching the rotary body according to claim 3, wherein the rotary shaft is a crankshaft of an internal combustion engine, and the rotary body is a flywheel press-fitted to an end portion of the crankshaft.

6. The method of attaching and detaching the rotary body according to claim 4, wherein the rotary shaft is a crankshaft of an internal combustion engine, and the rotary body is a flywheel press-fitted to an end portion of the crankshaft.

* * * * *